United States Patent [19]

Di Duca et al.

[11] 3,986,949

[45] Oct. 19, 1976

[54] AIR CLASSIFIER

[76] Inventors: Mark B. Di Duca, 15730 Shady Lane; Joseph C. Di Duca, 15720 Shady Lane, both of Los Gatos, Calif. 95030

[22] Filed: July 7, 1975

[21] Appl. No.: 593,528

[52] U.S. Cl. ..... 209/35; 209/137; 209/141; 209/300

[51] Int. Cl.[2] ..... B07B 9/02

[58] Field of Search ..... 209/30–37, 209/134–142, 153, 147, 146, 300

[56] References Cited

UNITED STATES PATENTS

| | | | |
|---|---|---|---|
| 1,077,947 | 11/1913 | Abrames et al. | 209/300 X |
| 1,250,554 | 12/1917 | Bryan et al. | 209/12 |
| 1,888,372 | 11/1932 | Bramwell | 209/139 R |
| 3,036,706 | 5/1962 | Taudiere | 209/35 |
| 3,378,140 | 4/1968 | Wochnowski et al. | 209/137 |
| 3,643,797 | 2/1972 | Berkowitz et al. | 209/33 X |
| 3,738,483 | 6/1973 | Mackenzie | 209/137 X |
| 3,856,217 | 12/1974 | Brewer | 209/135 X |
| 3,907,670 | 9/1975 | Fernandes | 209/137 |
| 3,929,628 | 12/1975 | Denevi et al. | 209/138 X |

FOREIGN PATENTS OR APPLICATIONS

| | | | |
|---|---|---|---|
| 275,909 | 10/1970 | U.S.S.R. | 209/139 R |

OTHER PUBLICATIONS

Boettcher, R. A. "Air Classification for Reclamation Processing of Solid Wastes," ASME Paper 69–WA/-PID–9, 1969.

*Primary Examiner*—Frank W. Lutter
*Assistant Examiner*—Ralph J. Hill
*Attorney, Agent, or Firm*—James D. Givnan, Jr.

[57] ABSTRACT

An air classifier for the separation of refuse by density into homogeneous fractions. A waste bin discharges non-homogeneous waste which is dispersed within a mixing chamber whereat a pressurized airflow, moving upwardly therethrough, carries lighter particles upwardly into a main duct structure. Subjacent the mixing chamber, is a crossflow zone through which a secondary airflow moves transversely to waste gravitating from the mixing chamber. The classifier air duct is of irregular shape having enlarged portions, spaced therealong, each constituting a waste separating station whereat waste of like density gravitates into a discharge chute associated with the station. Air inlet means at each station directs a crossflow of air onto the gravitating waste matter to remove lighter density particles comingled therewith and reentrain same in the main duct airflow. The crossflow of air additionally serves to wash an inclined surface of the main duct picking up particles and returning same to the main duct airflow while obviating undesired vortex formation. An auger housing, below each waste separation station, further classifies waste separated at that station by its physical size.

8 Claims, 3 Drawing Figures

24
25
26
27
28
29
30
31
32
33
34
35
36
37
38
39
40
41
42
43
44
47
48
49
50
51
52
53
54
55
56
57
58
59

AIR CLASSIFIER

BACKGROUND OF THE INVENTION

The present invention relates generally to solid waste separators and more particularly to those utilizing a flow of pressurized air through a duct structure separating non-homogeneous waste by density, such separators being termed air classifiers and used primarily at municipal waste disposal sites.

Existing classifier prior art, to the extent known, includes chutes or ducts of zig zag configuration through which an upward flow of air travels with waste being injected into the chute. Waste particles so injected are imperfectly separated into but two general categories, light and heavy fraction which require further classification such as by running same through a second air classifier. A serious problem exists in separating out lighter fraction such as waste paper, wood fragments and other organic materials. Common practice entails the use of multiple zig zag chutes.

Particle or fraction size and shape are additional factors in air classifying. Granular particles have a tendency to collect within vortices within the chute airflow and migrate downwardly along boundary areas adjacent chute walls. This results in recycleable material, such as waste paper being lost by reason of being improperly mixed with heavier waste fraction. Conversely, a problem exists in the mixing of glass splinters with paper fragments.

As the value of reclaimed waste is largely determined by the accuracy with which separation is accomplished, imprecise air classifying results in the loss of material which otherwise could be recycled. As the sale of reclaimed paper and other cellulose matter brings a sizable return to the disposal site operator, such a loss is highly undesirable.

SUMMARY OF THE INVENTION

The present invention concerns an air classifier separating refuse, primarily by density, wherein several waste classifications are possible.

Waste is discharged into an upward flow of air with means being provided for mechanically dispersing waste aggregate upon entry into the airflow. The previously shredded material has been subjected to at least coarse shredding and magnetic separation for removal of ferrous materials. To a large extent, the remaining waste to be separated may be grouped into non-ferrous metallic articles, plastic, glass and organic material such as waste paper and wood fragments. At stations along the present classifier refuse is separated out, primarily by density, with final separation accomplished in separator means such as one of the cyclone type.

A duct structure of the present classifier receives a continuous airflow into which waste is disbursed by mechanical means. Initial separation of heaviest density waste occurs as said waste gravitates through an upward flow of air. Lighter density material is conveyed to remaining waste separating stations. An air inlet, subjacent each station, directs an incoming secondary flow of air past comingled fraction separated at that station to remove lighter density particles therefrom for re-entry into the duct flow for later separation. The incoming secondary flow of air entering each station is directed so as to fluidize waste particles improperly separated at that station by vortex action.

Accordingly, the lighter particles are retained in the main duct flow until separation at the desired point. The secondary airflow entering the duct at each station may be bled from a main blower supplying the duct flow or from other sources depending on CFM requirements of the classifier. A discharge passageway below each station terminates in communication with a conveying instrumentality such as a screw feed for fraction removal.

Important objects of the present classifier include the provision of: a classifier separating waste into two or more classifications in an accurate manner heretofore not possible with zig zag type classifiers; a classifier providing multiple stations for waste separation whereat a crossflow of secondary air serves to re-entrain lighter density particles back into the main duct airflow for later separation; a classifier maintaining the loss of organic material to a minimum during separation of metal, glass, plastic, etc.; a classifier obviating the need for multiple classifiers or the re-classifying of waste by re-running of waste through a single classifier.

DESCRIPTION OF THE PREFERRED EMBODIMENT

Figure 1A:
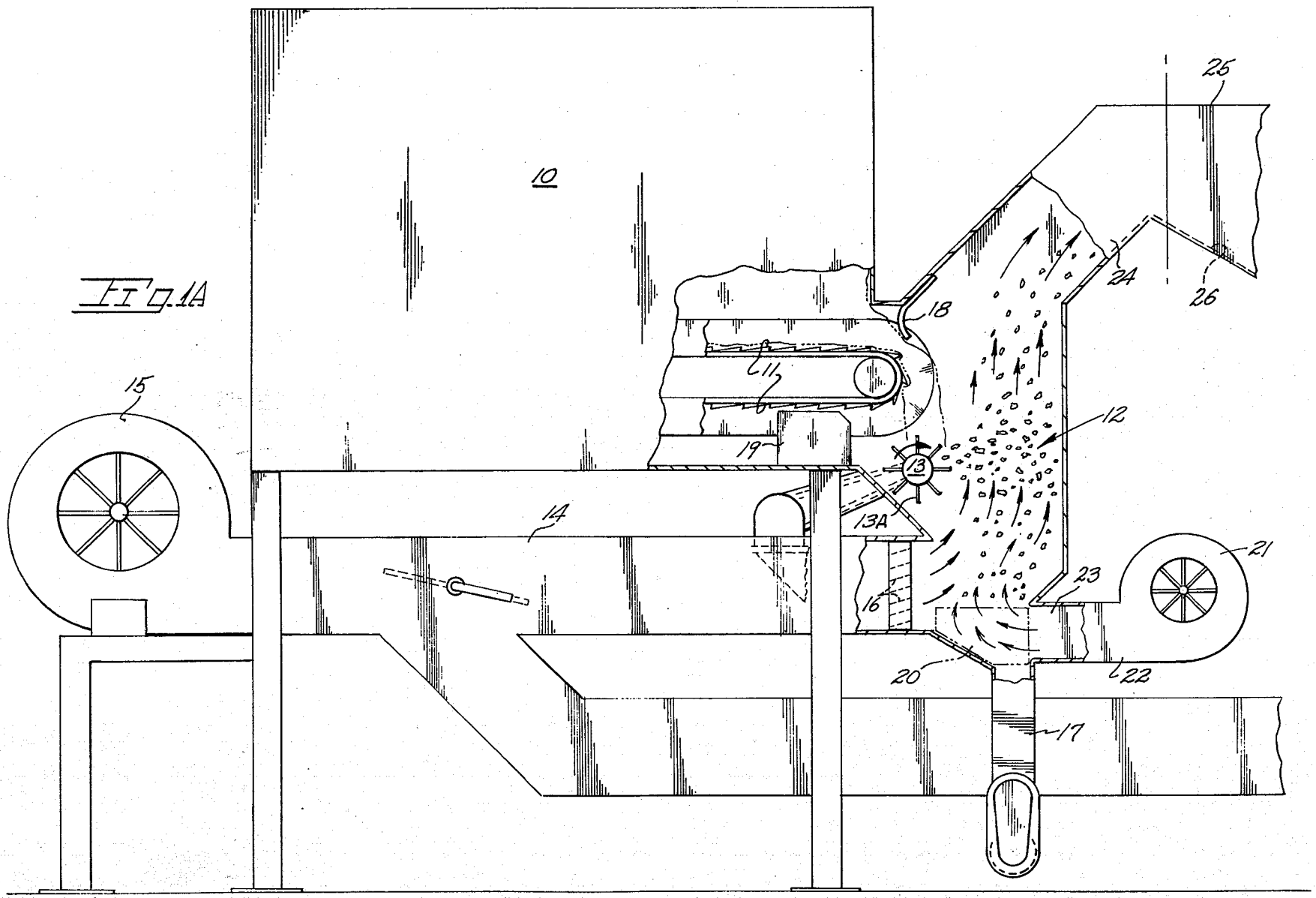
FIGS. 1A and 1B are side elevational schematic views of the present classifier contiguous at a common reference line.

With continuing reference to the accompanying drawings wherein applied reference numerals indicate parts similarly identified in the following description, the reference numeral 10 indicates a bin receiving non-homogeneous waste such as that from a municipal collection which has been subsequently shredded and subjected to magnetic separation for the removal of ferrous material. Current practice at waste disposal sites commonly includes coarse shredding of waste with the waste thereafter conveyed past a magnetic separation station.

Conveyor means at 11 feeds the bin contents into a mixing chamber indicated generally at 12 whereat a powered rotary spreader 13 breaks up agglomerated waste. Said spreader is of drum configuration having angularly projecting tines 13A which penetrate the waste clumps. Mixing chamber 12 receives the dispersed waste material and a continuous upward flow of air from a conduit 14 fed by a blower 15. Baffles at 16 divert the air upwardly toward said mixing chamber to carry lighter fraction upwardly therefrom while heavier fraction e.g., metal fragments, large glass fragments, gravitate toward a discharge chute 17. To prevent undesired air loss from mixing chamber 12, upper and lower air barriers at 18 and 19 are provided.

A first crossflow zone is indicated at 20 said zone receiving a secondary flow of air such as from a second blower at 21 having a discharge duct 22. Air entering the main duct via an inlet 23 impinges upon the earlier mentioned articles gravitating from mixing chamber 12 to remove lighter density particles comingled therewith returning said particles to the main duct flow.

An angulated duct structure includes a first duct angulation at 24 which routes the combined flows of air from the mixing chamber, and waste supported thereby, upwardly to waste separating stations the first of which is defined by a duct portion 25 of enlarged cross section. Said enlarged duct portion is partially defined by inclined wall surface 26 inclined relative to the axis of the main duct flow. At the separating station, an oppositely directed (opposite to the main duct flow) secondary flow of air is directed toward inclined surface 26 from air inlet means indicated at 27. The oppositely directed secondary airflow, entering via inlet means 27, may be provided by a conduit 28 in communication with ducting 14 or, alternatively, the same may be from an individual source such as a blower unit. The crossflow of air entering via inlet means 27 establishes a crossflow zone 29 with the crossflow impinging upon waste particles separated at the separating station. Accordingly, lighter density particles are removed from the heavier particles for re-entrainment into the main duct flow of air. Similarly, lighter density particles on or immediately above inclined surface 26, resulting from a superjacent vortex, are re-entrained in the main duct flow. Accordingly, the waste entering the throat of a discharge chute 30 is of very similar density resulting in it being, to a large extent, homogeneous. The crossflow prevents, to a large extent, the formation of a vortex above surface 26.

A second duct angulation at 31 directs waste laden air from the first separating station upwardly toward a second separating station defined by an enlarged duct portion 32 partially defined by an inclined duct surface 33. In similarity to the earlier described separating station, an air inlet means at 34 directs a crossflow of air into the main duct structure to establish a crossflow zone 35. A duct 36 provides an oppositely directed (opposite to the main duct flow) secondary airflow from a source such as branched conduit 14 or an alternative source such as a blower unit. In continuing similarity to the first station, air entering via inlet means 34 impinges upon waste material gravitating toward the throat of a discharge chute 37 to discharge lighter density particles and re-entrain same with the main duct airflow. Further, the crossflow washes inclined surface 33 of the main duct to pick up lighter density particles thereon for re-entrainment into the main duct airflow. Screw type conveyor means indicated generally at 38 and 39 serve to convey away particles separated at each station as later described. If so desired, shaker screens may be provided acting on the material discharged by the screw conveyors for additional separation.

Terminal separation of light density fraction such as paper and other organic material is provided by a separator 40 shown as a cyclone separator provided with an airlock 41 permitting material discharge without undue pressure drop. Waste bearing air is directed upwardly from the second separating station via a duct portion 43 which may be provided with adjustable baffles 44 to effect a desired tortuous flow. The main duct flow of air is discharged from the separator via a separator duct 42 which may be vented to the atmosphere or to a mechanical filter.

Figures 1B, 2:
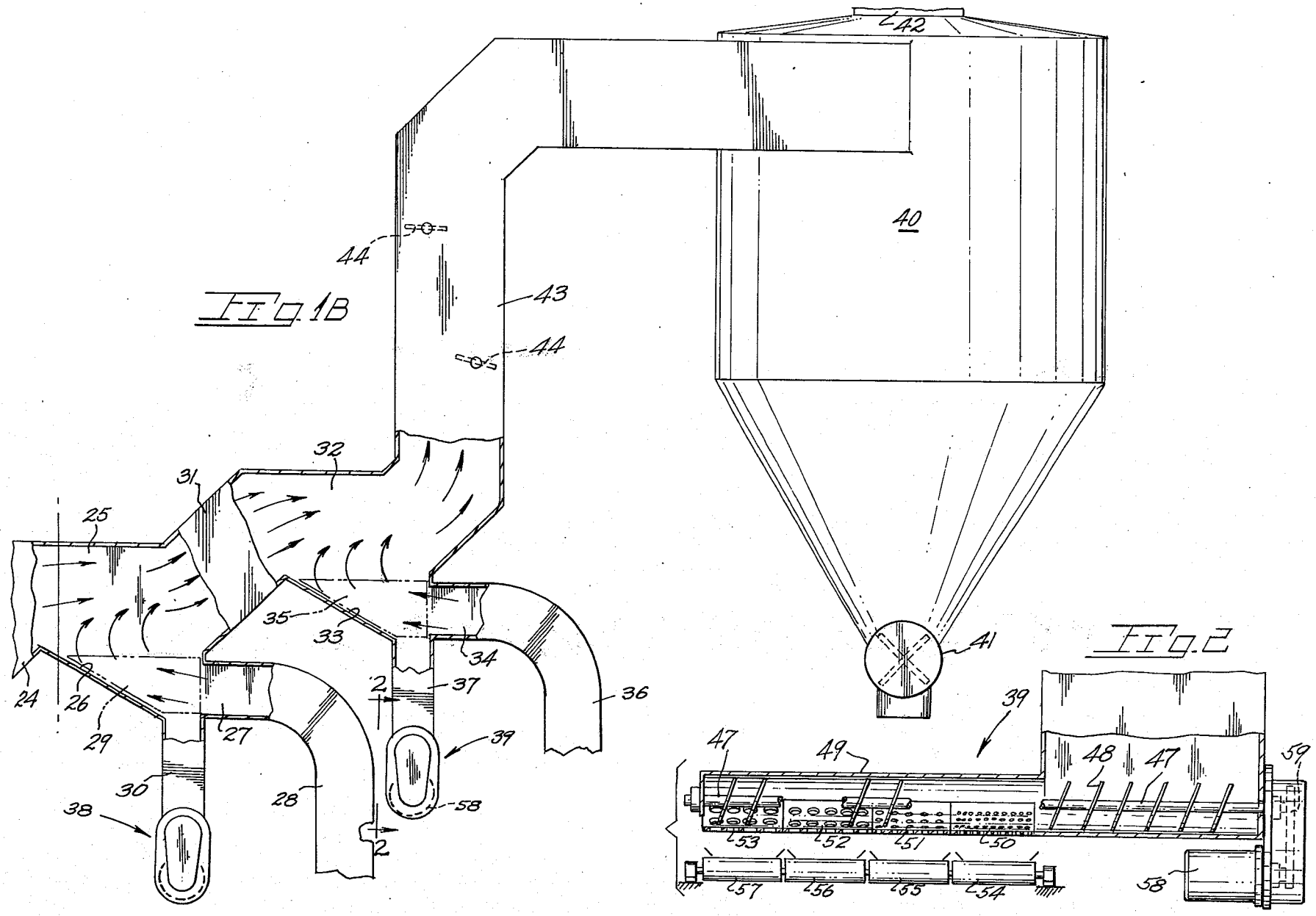
FIG. 2 is an elevational view taken along line 2—2 of FIG. 1B.

With attention to FIG. 2, wherein the lower end of a discharge chute 30 is shown, we provide an auger 47 with auger flights 48 disposed beneath the chute to receive separated fraction. An auger housing 49 extends outwardly beyond the side of the discharge chute and is provided with perforate lower portions indicated at 50 through 53 with the perforations of each of said portions being of increasing size. Spaced below each perforate area are receptacles which may be conveyor belts 54 through 57 for transfer of the material to separate storage areas. A gearhead motor 58 powers the auger via suitable power transmission means indicated at 59. Accordingly, fraction discharged from chute 30 travels along auger housing 49 until, by reason of its physical size, it passes through one of said perforate areas to the subjacent conveyor. The separation so accomplished is dependent solely on particle size and provides additional separation to that density separation accomplished in the main duct structure. The auger 47 is driven at a low R.P.M. with fraction occupying the space between auger flights preventing an airflow loss through the auger housing.

The operation of the present classifier is believed obvious from the foregoing description and that in some instances classifier operation may be entirely adequate without the arrangement shown in FIG. 2 for separation of fraction by physical dimensions.

While we have shown but a few embodiments of the invention it will be apparent to those skilled in the art that the invention may be embodied still otherwise without departing from the spirit and scope of the invention.

Having thus described the invention what is desired to be secured under a Letters Patent is:

1. In an air classifier for the separation of non-homogeneous waste material, the improvement comprising, a main air duct through which a primary waste carrying airflow travels in an upward manner, said duct being of non-uniform cross section with enlarged cross sectional portions defining waste separation stations spaced along the duct whereat waste is separated from the duct airflow primarily by waste density, each of said stations partially defined by an inclined main duct surface, a waste discharge chute in communication at its upper end with the main duct at each of said stations, and air inlet means at each of said stations admitting a secondary airflow into the main duct in a direction opposite to the duct airflow direction, said inlet means disposed so as to direct the secondary airflow transversely across the path of waste particles separated at that station whereby lighter density waste particles and the secondary airflow supporting same impinge upon the inclined main duct surface for passage therealong and ultimate upward re-entrainment into the main duct airflow for transfer to and removal at a subsequent separation station.

2. The invention claimed in claim 1 wherein said main air duct additionally includes upwardly angulated portions of uniform cross section interposed between said enlarged cross sectional duct portions defining said waste separation stations.

3. The invention claimed in claim 1 wherein said main duct includes an upper substantially horizontal wall portion at each station, said upper wall portion and said inclined duct surface at each station diverging from one another in the direction of the main duct airflow.

4. An air classifier comprising in combination, a storage bin for non-homogeneous waste material, a mixing chamber receiving an upward flow of air from a pressure source, spreader means discharging storage bin contents into said mixing chamber, a discharge chute for waste material in upward communication with said mixing chamber and receiving waste particles of heavier density gravitating from said mixing chamber, an air inlet at the throat of said discharge chute discharging a pressurized airflow directed transversely of the path of waste particles gravitating from the mixing chamber toward said discharge chute so as to fluidize the lighter particles for return to said mixing chamber, an upwardly angulated main duct structure in receiving communication with said mixing chamber, said duct structure having multiple waste separation stations located therealong whereat waste particles gravitate out of the duct structure airflow, each of said stations defined by an enlarged cross sectional portion of the duct structure, upwardly angulated duct portions of uniform cross section extending between said stations, a waste discharge chute in communication at its upper end with the main duct at each of said stations, and air inlet means spaced along the duct structure and discharging a secondary airflow in a direction opposite to the duct airflow direction at said separation stations transversely to the path of waste particles separated at that station for re-entrainment of some of the particles back into the duct structure airflow for later separation.

5. The air classifier claimed in claim 4 wherein said angulated duct structure additionally includes a wall surface at each of said separation stations inclined to the axis of the duct airflow and against which said secondary airflow impinges.

6. The air classifier claimed in claim 5 wherein the air inlet means at each of said stations is located immediately above the upper end of each discharge chute.

7. The air classifier claimed in claim 6 wherein said inclined wall surface of each separation station is coterminous with the upper end of a discharge chute and opposite said air inlet means.

8. The air classifier claimed in claim 7 additionally including conveyor means in receiving communication with each of said discharge chutes, said conveyor means including a housing through which waste particles are transferred, said housing having perforate portions with each portion defining waste receiving openings of a different size than those of a remaining housing portion so as to further separate particles by their physical dimensions.

* * * * *